United States Patent [19]

Drugge

[11] Patent Number: 4,681,300

[45] Date of Patent: Jul. 21, 1987

[54] APPARATUS FOR REMOVING MANHOLE COVERS AND THE LIKE

[76] Inventor: Folke N. Drugge, 54 Lillsvangen, 126 57 Hagersten, Sweden

[21] Appl. No.: 717,520

[22] Filed: Mar. 29, 1985

[30] Foreign Application Priority Data

Mar. 30, 1984 [SE] Sweden ..... 8401754

[51] Int. Cl.[4] ..... B66F 3/00

[52] U.S. Cl. ..... 254/131

[58] Field of Search ..... 254/131, 126

[56] References Cited

U.S. PATENT DOCUMENTS

| | | | |
|---|---|---|---|
| 2,249,603 | 7/1941 | Elkington | 254/126 |
| 3,353,790 | 11/1967 | Drier | 254/126 |
| 4,076,217 | 2/1978 | Haller et al. | 254/131 |
| 4,157,809 | 6/1979 | Haller et al. | 254/131 |
| 4,157,811 | 6/1979 | Haller et al. | 254/131 |
| 4,482,182 | 11/1984 | Mortensen | 254/131 |

FOREIGN PATENT DOCUMENTS

| | | |
|---|---|---|
| 2646646 | 10/1976 | Fed. Rep. of Germany . |
| 1438529 | 4/1966 | France . |

*Primary Examiner*—Frederick R. Schmidt
*Assistant Examiner*—Judy J. Hartman
*Attorney, Agent, or Firm*—Finnegan, Henderson, Farabow, Garrett & Dunner

[57] ABSTRACT

A beam having intermediate the ends thereof at least one guide for a grab element provided to be detachably connected to the cover and at one end thereof has a support provided to act against a surface outside the cover and at the opposite end thereof a screw spindle, which is rotatably connected to a shoe, provided to act against a surface outside the cover and diametrically opposed to the first-mentioned surface.

The beam is further provided with guide means for receiving one end of a lever in such a manner that the lifted up cover can be pivoted about the rotational axis of the shoe to a place beside the manhole opening.

The lever is preferably shaped as a spanner and has a key to operate the screw spindle as well as cocks and the like.

7 Claims, 2 Drawing Figures

APPARATUS FOR REMOVING MANHOLE COVERS AND THE LIKE

Figure 1:
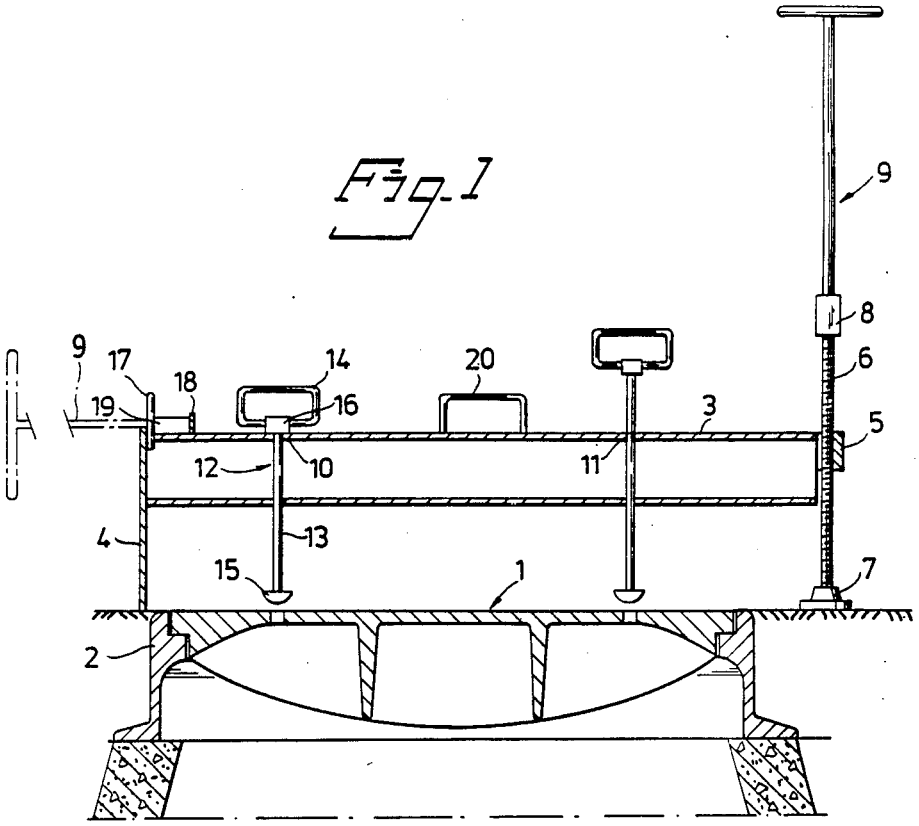

This invention refers to an apparatus for removing manhole covers and the like from their frames.

Street gullies and similar wells are usually surrounded by an annular element which normally is closed by a cover.

For inspection, maintenance and repair of sewage disposal systems, district heating plants and the like which are frequently located in covered ground surface such covers have to be removed. The cover itself is comparatively heavy since it is usually made from cast iron, but the removal is further rendered difficult by the fact that the cover is fitted in the annular element such that the gap between said element and the cover is minor. Additionally said gap is usually filled up by sand and gravel and in wintertime also ice.

In order to facilitate the lifting of the cover the latter is usually provided with rectangular openings through which grab elements may extend. After having turned or otherwise manipulated said grab elements such that they grab the cover attempts have been made to lift the cover by means of said grab elements. Since the cover usually is stuck very hard it has only exceptionally been possible to remove it in such a manner. Consequently prying by means of iron bars, heating for de-icing and similar primitive methods have been used but these methods suffer from being time consuming and most commonly necessitate co-operation of several persons.

Various special tools and apparatuses for the purpose have been suggested but such aids have not found an extensive use due to complicated structure, difficulty in handling or the like.

One object of the invention has therefore been to provide a simple and cheap apparatus by means of which one single person rapidly can lift up the manhole cover and carry it aside to make the manhole available for descent and the like.

Another object has been to provide an apparatus which is easy to carry and which also contains a tool for operating cocks and similar operations with relevance to manhole work.

To accomplish these and other objects the invention has the characteristics pointed out in the claims.

The accompanying drawing illustrates an exemplary embodiment of the invention.

Figure 2:
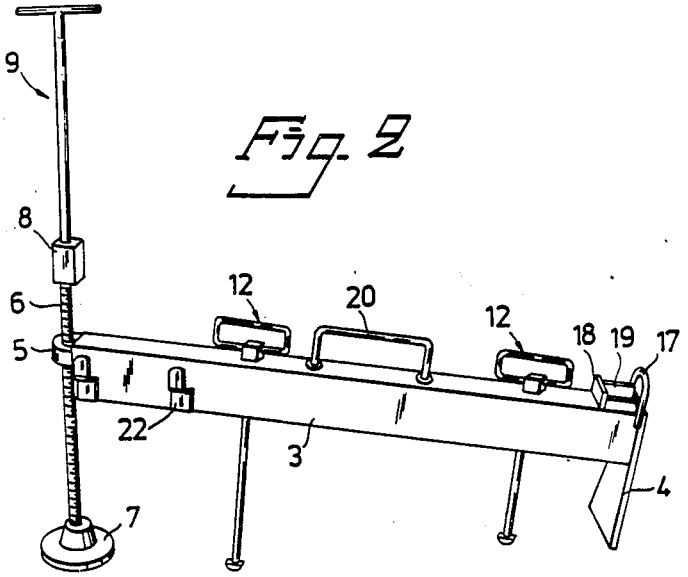

In the drawing:

FIG. 1 is a section through the apparatus shown in use for lifting up a manhole cover and FIG. 2 is a perspevtive view of the apparatus.

In the drawing numeral 1 designates a cover which is intended to cover the opening of an annular element 2, which surrounds the mouth of the manhole. Since FIG. 1 illustrates the upper portion of a street gully the upper surface of the annular element is substantially level with the street-paving and it is surrounded by sand or gravel and in the upper region by bitumen.

The new apparatus comprises a beam 3 which in one end thereof has a support element 4 secured thereto. Said support element extends substantially at right angle to the beam and preferably has a shape similar to the one shown in FIG. 2. In the opposite end thereof the beam has a threaded collar 5 for a screw spindle 6 which by means of a ball joint or the like is turnably connected to a shoe 7. In the upper end thereof the screw spindle is shaped so as to be drivingly connectable to a correspondingly shaped socket 8 of a preferably T-shaped spanner 9.

In the drawing the upper end of the screw spindle is square and tapered and the socket has a corresponding inner shape. For a purpose to be described the socket also has an outer square shape.

It is evident that the screw spindle can be turned by means of the spanner 9 which is a separate accessory to the apparatus and thus serves two purposes.

Through openings 10 and 11 of the beam extend grab elements 12 which in the illustrated embodiment each comprise a straight rod 13, having in one end thereof a handle portion 14 and in the other end thereof a catch 15. Secured to the rod is further a stop member 16.

The grab elements 12 are pivotable relative to the beam 3 and may be displaced axially within the limits set by the stop member 16 and the catch 15.

At the left hand end of the beam there is according to FIG. 2 provided a yoke 17 in the shape of an inversed U, the flanges of which are located at such a distance from each other that the socket 8 of the spanner 9 can pass therebetween. The beam also has stop members 18 and side walls 19 (one being removed in FIG. 2) to form a seat for the socket 8. To ensure that the spanner is fixed against rotation when the socket of the spanner is received in said seat the socket 8 preferably is of square section as mentioned.

A handle 20 for carrying the apparatus is secured to the beam at the centre of gravity of the apparatus. The apparatus further has brackets 22 which may be resilient for detachably holding the spanner 9.

In use the apparatus is placed over the cover in the illustrated manner, i.e. such that the support element 4 contacts a surface outside the periphery of the cover while the grab elements are in positions over the substantially rectangular openings which are provided in the cover for cooperation with the catches. The length of the beam is such that the shoe 7 will then contact a surface which is outside the periphery of the cover and preferably diametrically opposed to the first mentioned contact surface.

By inserting the grab elements in the rectangular openings of the cover and turning them such that the catches 15 thereof engage the under side of the cover and then rotate the screw spindle in one direction the cover will be lifted up from the annular element 2 since the beam 3 with the support element 4 thereof will act as a lever. When the cover has been raised to such an extent that it has left the annular element 2 the spanner is withdrawn from the screw spindle and instead inserted in the yoke 17 as indicated in dotted lines in FIG. 1. By means of the spanner it is now possible to pivot the apparatus and the cover suspended thereby about the centre of the shoe 7 to a position beside the manhole opening.

As already mentioned the spanner can now be used to shut and open cocks in the manhole and other installations related thereto and of course the operations to re-situate the cover are the same as described but in reversed order.

The apparatus now described can easily be carried by a man and one man can also remove manhole covers also under very unfavourable weather conditions.

It has been found convenient to design the catches 15 with a curved lower edge since it will thereby be possible to rinse the portions surrounding the rectangular openings.

I claim:

1. An apparatus for removing a manhole cover from a manhole, comprising:

a beam member having a first end and a second end;

means cooperating with said beam member for grabbing the manhole cover, said grabbing means including at least one grab element having a rod portion passing through said beam member intermediate said first and second ends and a catch portion at one end of said rod portion, said catch portion being adapted to detachably connect to the manhole cover;

means connected to said beam member for supporting said first end of said beam member a predetermined distance above a fulcrum position on a surface outside the perimeter of the manhole cover when the manhole cover is within the manhole;

raising means threadably connected to said beam member for adjustably supporting said second end of said beam member a variable distance above a pivot position on the surface outside the perimeter of the manhole cover when the manhole cover is within the manhole, said pivot position being substantially diametrically opposite said fulcrum position with respect to the manhole cover, whereby the manhole cover is raised from the manhole when the said catch portion of said grabbing means is connected to the manhole cover, said raising means including shoe means for pivotally supporting said beam member at said pivot position, a threaded collar member mounted on said beam member proximate said second end, and a screw spindle threadably engaged with said threaded collar member and having one end pivotally connected to said shoe means; and lifting means for lifting said first end of said beam member to a position above said predetermined distance above said fulcrum position and for pivoting said beam member about said pivot position, said lifting means including a spanner-shaped lever having a socket portion at one end thereof and a yoke member and quide means mounted on said beam member proximate said first end for receiving said socket portion of said lever, whereby the manhole cover connected to said catch portion of said grabbing means is pivotable to a position beside the manhole by lifting said lever and pivoting said lever about said pivot position when said lever is received by said yoke member and guide means, said socket portion of said lever being removable from said yoke member and guide means and engageable with the end of said screw spindle opposite said shoe means so that rotation of said lever and socket portion rotates said screw spindle.

2. The apparatus of claim 1, further comprising a carrying handle mounted on said beam member at approximately the center of mass of said apparatus.

3. The apparatus of claim 1, wherein said guide means includes at least one side wall and said socket portion includes an outer surface having at least one planar portion engaging said side wall of said guide means at times when said guide means receives said socket portion to prevent rotation of said socket portion in said guide means.

4. The apparatus of claim 1, wherein said grab element is pivotable with respect to said beam member about the axis of said rod portion.

5. The apparatus of claim 1, wherein said rod portion of said grab element is axially slidable with respect to said beam member.

6. The apparatus of claim 1, wherein said catch portion of said grab element has a curved lower surface.

7. The apparatus of claim 1, wherein said at least one grab element includes two grab elements.

* * * * *